US005412853A

United States Patent [19]

Catallo

[11] Patent Number: 5,412,853

[45] Date of Patent: May 9, 1995

[54] APPARATUS FOR FINISHING A FABRIC WEB

[76] Inventor: Frank Catallo, 75 Channel Dr., Port Washington, N.Y. 11050

[21] Appl. No.: 125,130

[22] Filed: Sep. 21, 1993

Related U.S. Application Data

[63] Continuation of Ser. No. 873,806, Apr. 27, 1992, abandoned.

[51] Int. Cl.[6] ..... D06C 21/00

[52] U.S. Cl. ..... 26/18.6; 26/20

[58] Field of Search ..... 26/18.5, 19, 20, 18.6, 26/80, 83, 116

[56] References Cited

U.S. PATENT DOCUMENTS

| | | | |
|---|---|---|---|
| 1,837,408 | 12/1931 | Cluett | 26/18.6 |
| 2,262,268 | 11/1941 | Chatfield | 26/18.6 |
| 2,335,313 | 11/1943 | Rowe et al. | 26/18.6 |
| 2,368,637 | 2/1945 | Bruenner et al. | 26/18.6 |
| 2,522,663 | 9/1950 | Chatfield | 26/18.6 |
| 3,007,223 | 11/1961 | Wehrmann | 26/18.6 |
| 3,098,279 | 7/1963 | Brunner | 26/18.5 |
| 3,195,211 | 7/1965 | Wehrmann | 26/18.6 |
| 3,409,960 | 11/1968 | Dusenbury et al. | 26/18.6 |
| 3,471,363 | 10/1969 | Schmidt | 26/18.6 |
| 4,044,434 | 8/1977 | Bryan | 26/18.5 |
| 4,146,946 | 4/1979 | Plaia et al. | 26/18.5 |
| 4,363,161 | 12/1982 | Catallo | 26/18.6 |
| 4,575,909 | 3/1986 | O'Brien et al. | 26/18.6 |
| 4,908,918 | 3/1990 | Strahm et al. | 26/18.6 |

FOREIGN PATENT DOCUMENTS

| | | | |
|---|---|---|---|
| 846085 | 7/1949 | Germany | 26/20 |

*Primary Examiner*—Clifford D. Crowder
*Assistant Examiner*—Amy B. Vanatta
*Attorney, Agent, or Firm*—Leo Fornero

[57] ABSTRACT

An apparatus for finishing a fabric web by subjecting a usually wetted fabric which is carefully handled preferably on a spreader in the case of knits or a tenter-like device in the case of woven or non-woven webs so that it remains flat and smooth and then presenting the fabric to a fabric treating station comprising endless belts in abutting relationship to shrink or finish the fabric and finally removing the fabric from the fabric treating station or arrangement. An apparatus for finishing a fabric by passing a carefully handled fabric onto a device to smooth the fabric and move same to a confined space formed by side by side plural, usually endless, belts with guide means on the outer surfaces thereof and said plural belts arranged to change direction around inner rolls disposed on the opposite ends of said belts to finish or shrink said fabric either as a result of the curvature caused by the change in direction of said belts or in the nip formed by the rolls at one end. The belts are disposed relative each other so that a confined space is formed between the belts wherein a finishing treatment may be applied as desired.

4 Claims, 3 Drawing Sheets

APPARATUS FOR FINISHING A FABRIC WEB

This is a continuation of application Ser. No. 07/873,806, filed Apr. 27, 1992, which is now abandoned.

BACKGROUND OF THE INVENTION

The invention relates to an apparatus for finishing or compressively shrinking a web made from a fibrous material.

A number of approaches have been developed in the past to utilize a belt to shrink fabric by taking advantage of the belt's ability to facilitate the compaction of fabric. Normally this compaction is achieved by using a shoe or some similar device for keeping the fabric confined in a narrow space to maintain the shrinkage that occurs during the elastic band effect that the curvature of the belt has.

The only patent that I am aware of that uses cooperating plural endless belts to achieve shrinkage of knits, in particular, is that to Wehrmann U.S. Pat. No. 3,007,223. Wehrmann goes on to state that the prior art, while suggesting various devices for longitudinally compacting fabric, has not achieved sufficient restoration of both the loops and fibers nor has it achieved sufficient uniformity of restoration. He says in certain of the old type shrinkers additional distortions have resulted.

Wehrmann utilizes the concept in many well known single belt shrinkers wherein the inner surface of an endless belt moves at the same speed at the turns as at the straight away portions but at the outer surface at the turns caused by suitably placed rolls on a belt of substantial thickness the belt moves at a faster speed. Therefor fabric will be compacted longitudinally as it is first propelled by the turn of the outer surface and will first be moved at a high rate of speed and later at a lower rate of speed through the action of the inner belt surface. Another reason why this occurs in Wehrmann is that a backing, in his U.S. Pat. No. 3,007,223, referred to as a cloth or a wire, is applied to the inner surface of the belt so that outer surface of the belt stretches and inner surface does not. Also this backing prevents the longitudinal stretching of the endless belts in Wehrmann.

Through this concept and the utilization of plural belts Wehrmann states that he is able to achieve high shrinkages.

In U.S. Pat. No. 4,575,909 many of the deficiencies of Wehrmann U.S. Pat. No. 3,007,223 are enumerated and one that is highlighted is caused by extending the spreader of Wehrmann into the entry space formed by the upper and lower belts. In the Wehrmann U.S. Pat. No. 3,007,223 the spreader acts as a confining means for the fabric and presses the fabric against the belts and rollers to cooperate in the shrinkage process. However it is stated that sometimes the spreader extension engages a belt and damage occurs. Also due to the closeness of the extension and the propensity to correct fabric jams, sometimes an operator catches himself in this confined area. This type of construction is shown in FIG. 4 of the drawings for illustrative purposes.

In U.S. Pat. No. 4,575,909 it is stated that the above drawbacks are overcome by its teaching of a belt operating in cooperation with an expandable shoe but there are drawbacks in this concept; namely, and in order to assure that fabric shrinkage is accomplished across the entire width of the fabric, it becomes necessary to extend the shoe beyond the width of the fabric which causes wear on the belt prematurely. By using a shoe and a belt in combination there is a tendency to have a different look on the opposite sides of the fabric which is often undesirable.

The fabric of the present invention is usually wetted then moved on a device such as a tenter or spreader depending on the type of fabric being finished and presented to a fabric treating station or arrangement. The fabric may be moved on a device which not only moves the fabric but maintains same in a smooth and flat state. Of course, as will be understood by one skilled in this art, this may be accomplished in separate stages and the fabric presented or introduced to the fabric treating arrangement or station in a flat and smooth state for finishing. The fabric is presented to the fabric treating station where the fabric enters a confined area or space formed by over and under or side by side belts abutting each other to form said space. The belts usually endless are pushed into tight abutment with each other to keep the fabric running therebetween flat, smooth and free of wrinkles. The belts, on the interior portion thereof, and at both of their opposite ends are provided with over and under or side by side rolls which cooperate in the compaction treatment so that the fabric entering the space and moved by the belts is shrunk or finished.

If desirable the fabric web may be shrunk in the confined space, and this is accomplished by running the pair of rolls at the fabric entry end of the fabric treating station at a faster speed then the pair of rolls, also as over and under at the opposite end of the station. By providing fully resilient belts and urging them in pressing abutment there is achieved a longitudinal compaction as the belts are first moved at a higher rate of speed and stretched along with the fabric therebetween, and then at a lower speed as a result of the slower speed of rolls at the other end of the fabric treating station so that shrinkage occurs. The principle of shrinking by retarding one roll and running the other roll at a faster speed is shown and discussed in U.S. Pat. No. 4,363,161. However the concept of this patent does not show or envision plural belts or utilizing the space therebetween as disclosed herein to shrink or finish fabric. The additional benefit of utilizing plural belts permits complete confinement of the fabric between the belts and in the space so that it is possible to achieve highly similar finishes across the entire width of the fabric web and on both of the sides.

In one of its forms the method and apparatus disclosed provides a fabric treating arrangement which includes a compaction arrangement that shrinks or finishes in any or all of three stages such as a nip, from curvature of a belt as it runs around the rolls or by that occurring in a space formed between the belts and resulting from belt stretch caused by the faster speed provided the rolls near the fabric entry end relative those at the other end of the belts.

As is well known different degrees of shrinkage may be achieved in a nip contemplated herein, from zero to higher degrees depending on the amount of pressure exerted by the nip on the fabric passing therebetween.

It is desirable to form the nip between two self abutting belts through which the fabric flows and by exerting pressure to the belts by moving one roll of the nip against one of the belts as is outlined below.

The higher costs and inefficiencies caused by such prior art practices are self evident and other efforts at reducing them have not really been effective.

The method and apparatus proposed herein reduces these deleterious effects while at the same time providing the benefits of reduced cost, a more suitable finish to both sides of the fabric, is efficient in its operation and inexpensive to manufacture.

For a more complete understanding of the invention and other features and advantages thereof reference should be made to the following detailed description of a preferred embodiment and to the accompanying drawings.

BRIEF DESCRIPTION OF THE DRAWINGS

In the drawings wherein like reference numerals denote corresponding parts through the several views.

GENERAL DESCRIPTION OF THE INVENTION

Figures 1, 4:
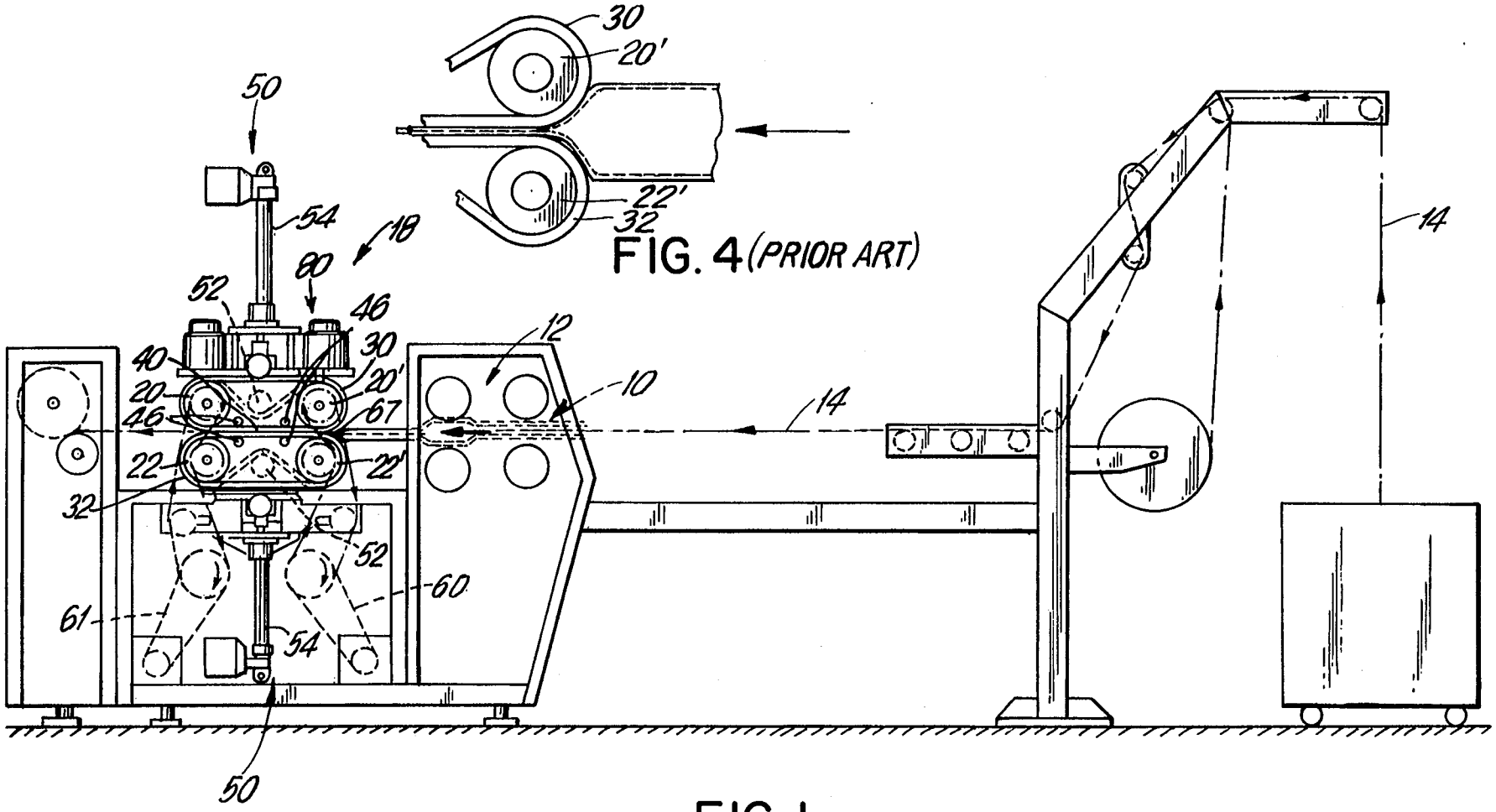
FIG. 4 (PRIOR ART)
FIG. 1 is a side view of the apparatus for treating a fabric web.
FIG. 4 is a partial side section showing a type of extension like Wehrmanns which cooperates with the rolls and belts of Wehrmann to shrink fabric.

Broadly in accordance with the present invention a method and apparatus are provided for finishing or compressively shrinking a fabric which is preferably at ambient moisture content, usually up to about 7 per cent moisture retention, a support system taking the form of the well known spreader 10 for knit type fabrics is shown. A steaming type chamber 12 also well known may be utilized to add about 4 per cent moisture to the fabric. It may be desirable to have completely wetted fabric in certain applications of the apparatus and any method well known in the art to eliminate the need of a steamer may be substituted, for example the fabric may be brought to a tenter type device in the wet state. The fabric may then be presented to the fabric treating arrangement as described herein.

The wetted fabric 14 is then processed or treated on the fabric treating arrangement 18 which comprises plural rolls 20 & 20' spaced from each other in a usually horizontal plane 24 passing through the center of said rolls. Another set of rolls 22 & 22' comprising a second set are also spaced from each other in another usually horizontal plane 26 passing through the center of said second set of rolls. A belt 30, usually endless, is disposed around the first set of rolls 20 & 20' and a second belt 32 is disposed around the second set of rolls 22 & 22'. While endless belts are preferred any belt which meets this general criteria and meeting the requirements set forth herein will suffice. Also while the rolls are shown in an over and under relationship any disposition meeting the standards and objectives outlined in this material will be satisfactory. For example, if a vertical disposition of the fabric treating arrangement 18 is utilized the rolls would be in a side by side relationship and the planes referred to in FIG. 5 would also be vertical.

Figure 2:
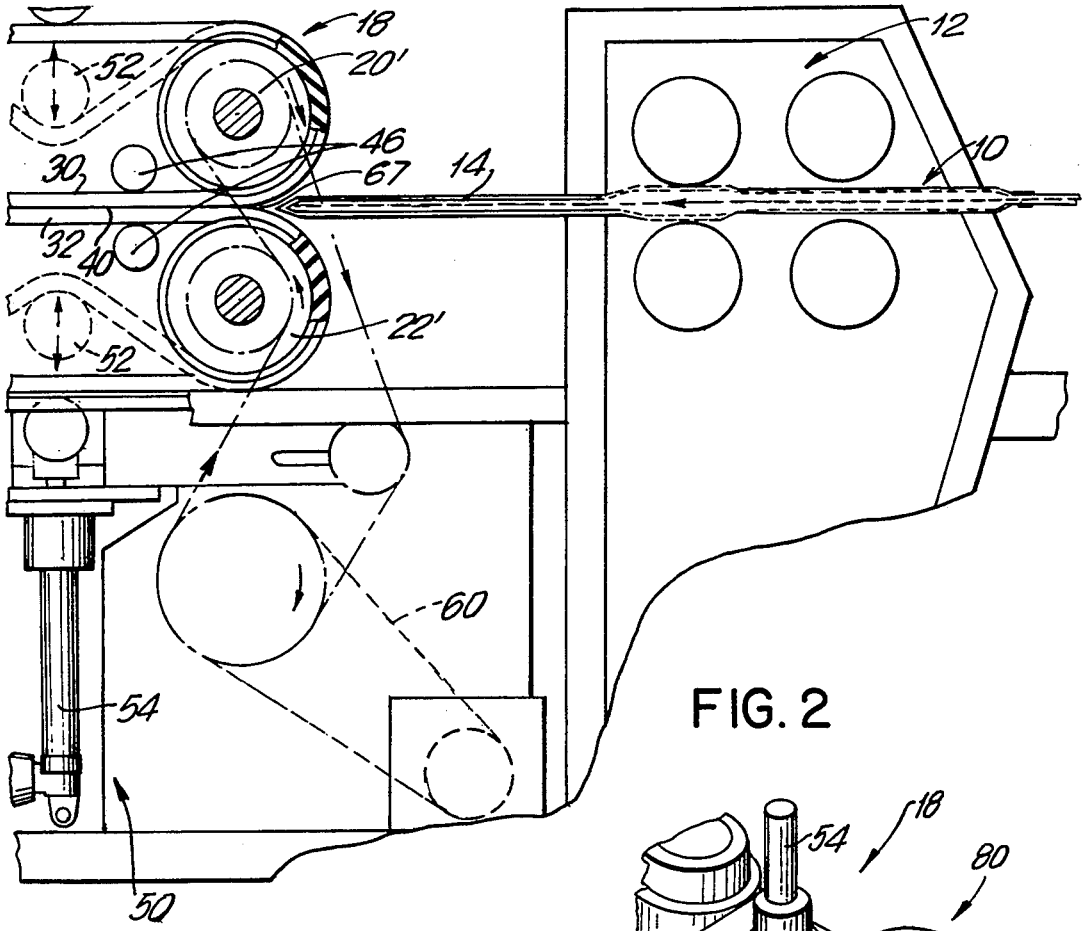
FIG. 2 is a partial side cross section showing the spreader and a partial side cross section of one form of fabric treating arrangement contemplated herein with the spreader positioned to feed fabric into the arrangement.
Figure 3:
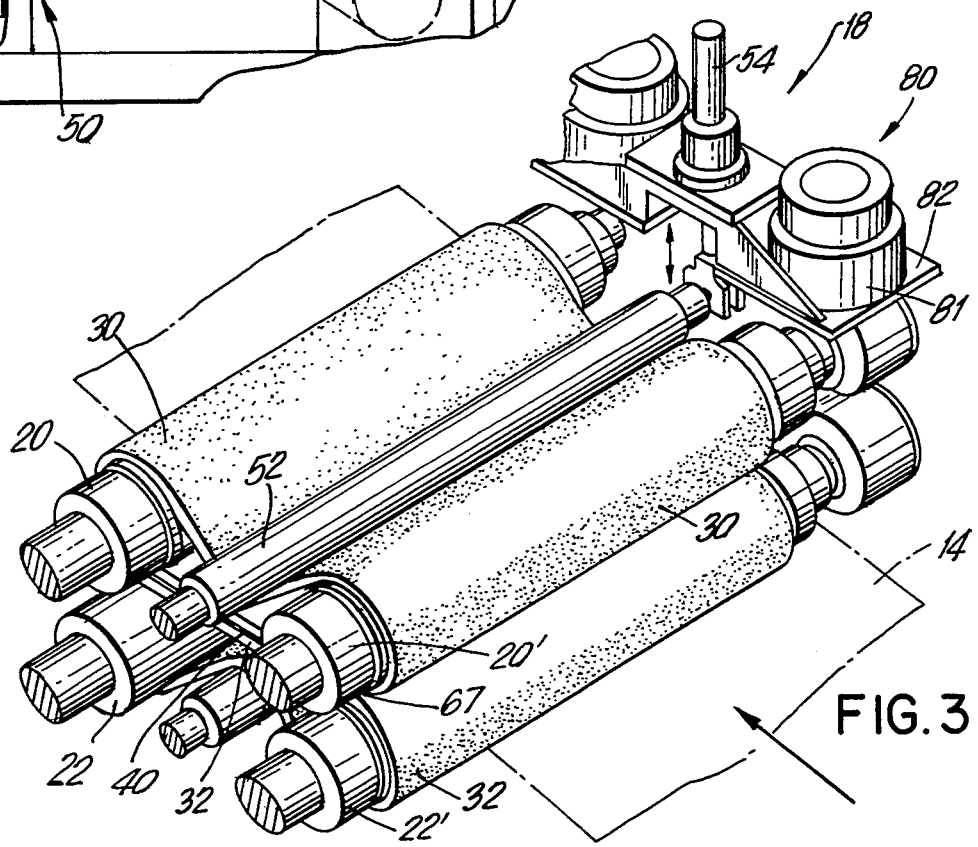
FIG. 3 is a perspective view of the rolls and one form of guide means for the endless belts shown.
Figure 6:
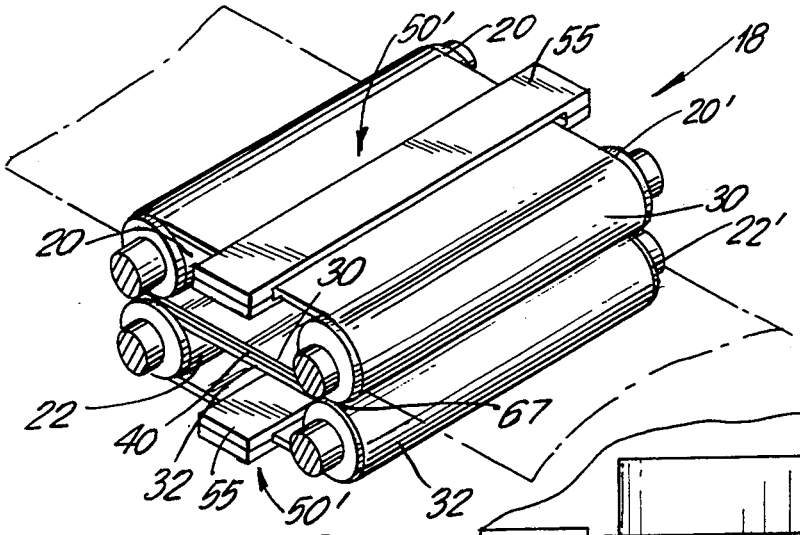
FIG. 6 is a perspective view of the fabric treating arrangement showing a different form thereof.

The belts 30 & 32 are disposed in abutting relationship as shown in the drawings, particularly FIGS. 2, 3 and 6. In this fashion a substantial area of abutment 40 is provided as best seen in FIGS. 3 and 6. To apply a fabric squeezing affect in this area or space 40 a plurality of rollers 46 are disposed on the inner portions of the belts 30 & 32.

One of the features of the invention is the ability to achieve longitudinal shrinkage of the fabric in the space 40 which results by making both of the belts 30 and 32 with a degree of resiliency while at the same time driving the rolls 20' and 22' at a greater rate of speed then rolls 20 and 22. Drive arrangements well known in the art are provided and designated 60 and 61 and may be variable speed drives of either the electrical, mechanical or other types.

By providing the resilient belts and the differential speed a stretching of the belts occurs and by confining in a pressed state the fabric 14 in the space 40 a predetermined amount of fabric shrinkage takes place. By adding the shrinkage in space 40 with that achievable in the nip 67 and due to belt curvature high rates of shrinkage of more than 20 per cent are attainable. The arrangement may be utilized as a finishing system by reducing the shrinkage between the belts so that a calendering application is applied and shrinkage is limited to the nip and belt curvature. Other combinations of fabric shrinkage are possible all within the teaching of this invention.

Suitable devices for moving the rolls 20' and 22' towards each other or farther apart to cause a squeezing of the belts passing through the nip 67 formed by the belts and rolls may cause fabric compaction or shrinkage as desired.

Figure 8:
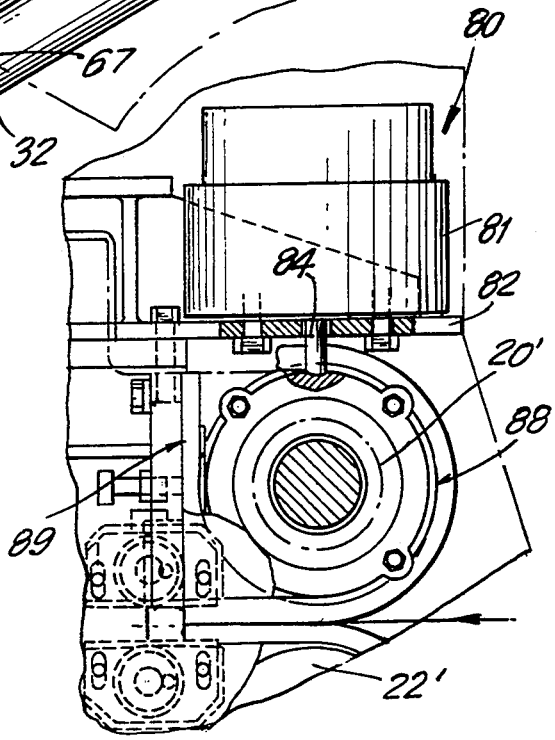
FIG. 8 is a partial end cross section showing one form of nip pressurizing mechanism.

One such mechanism 80 is shown in FIG. 8 and is of the pneumatic type wherein an air cylinder 81 moves plate 82 and rod 84 to exert pressure to the roll 20'. A suitable bearing and housing arrangement 88 and mounting surface 89 are also shown.

Figure 5:
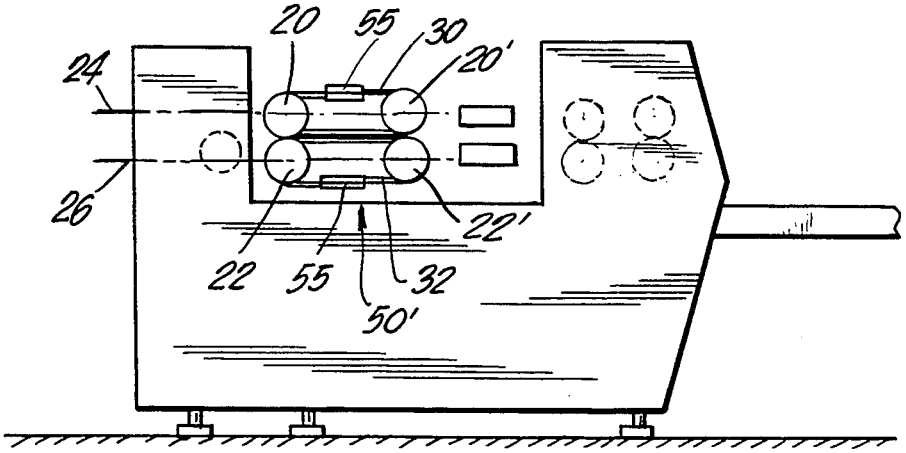
FIG. 5 is a side view of another form of apparatus for treating fabric as described herein.
Figure 7:
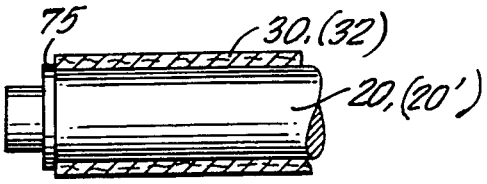
FIG. 7 is a partial cross section of a roll showing another form of belt guide means.

Depending on the type of belt material used to treat the fabric, in certain instances, particularly if an endless felt belt, as is shown in FIGS. 5, 6 and 7, is used, a calendering affect may be achieved. Also shrinkage will occur in the nip portion 67 and from the belt curvature as described herein, of the fabric treating arrangement.

Also it is contemplated to utilize a belt guide system 50. In FIGS. 1, 2 and 3 a roller 52 mounted on an adjustable rod 54 which is moved by a well known control that senses belt position and the roller 52 is disposed against the top of belt 30 and another guide unit identical to the first is mounted on the lower or bottom endless belt 32. These units form guides to keep the belts in proper longitudinal alignment.

In the fabric treating arrangement of FIG. 5 a guide system 50' keeping the belts taught utilizes a belt guide retainer 55 as shown in FIG. 6 which causes the belts to ride in true alignment on the rolls. The felt belt guide retainers 55 also function like the rolls 52 on the belts 30 & 32 to serve to keep them straight or true.

Flanges 75 in FIG. 7 may also be used to keep the belts 30 and 32 in alignment particularly in the fabric treating arrangement shown in FIG. 5.

Another important feature of the invention is to achieve a high degree of shrinkage without the difficulties known heretofore. None of the art that I am aware of teaches three stage shrinking by utilizing the belt curvature at the rolls 20', 22' shrinkage at the nip 67 formed by the rolls and shrinkage resulting in space 40 by slowing down the rolls 20'& 22' relative the rolls 20 & 22 so that an enhanced shrinkage control results. This may be on the order of more than twenty per cent and is particularly beneficial in the shrinkage of knits. To my knowledge to achieve such rates of shrinkage control particularly in an uncomplicated machine is most desirable and also it is particularly so if such a machine provides a better fabric having two sides both including a desirable and uniform surface and a high quality appearance as the apparatus disclosed achieves.

It should be understood of course that specific forms of the invention herein illustrated and described are intended to be representative only as certain changes may be made in the invention without departing from clear teachings of the disclosure. Accordingly, reference should be made to the following appended claims determining the full scope of the invention.

I claim:

1. Apparatus having an entry end and an exit end and said apparatus for finishing a fabric web and comprising in combination:

a) a fabric presenting means for said apparatus;

b) means for said apparatus to maintain the fabric web in a flat and smooth state;

c) a fabric treating arrangement for said apparatus;

d) said fabric presenting means adapted to deliver said fabric web into said fabric treating arrangement;

e) plural roll means for said fabric treating arrangement;

f) two of said plural roll means disposed in side by side relationship and on a first same side of said fabric treating arrangement;

g) two other of said plural roll means disposed in side by side relationship and on a second same side of said fabric treating arrangement; two of said plural roll means being disposed at the entry end of said fabric treating arrangement and in vertical alignment to form a first pair of rolls;

i) two of said plural roll means disposed at the exit end of said fabric treating arrangement and in vertical alignment to form a second pair of rolls;

j) Plural belts for said fabric treating arrangement and each belt being of a pre-determined width;

k) one of said belts disposed to run around one of said first pair of rolls and one of said second pair of rolls and said rolls being on said first same side;

l) the other of said belts disposed to run around another of said first pair of rolls and another of said second pair of rolls and both of said rolls being on said second same side;

m) said first pair of rolls being in vertical alignment and adjustable to cause said belts to abut one another to form a nip therebetween and said nip being located at the vertical center line passing through each of said first pair of rolls;

n) said belts also being disposed relative each other to provide a space therebetween for finishing said fabric web;

o) said belts also being disposed to move around said first pair of rolls in a curved path;

p) said fabric web being sandwiched in said space between said belts;

q) said fabric web to move in said fabric treating arrangement and said belts and said sandwiched fabric web to move through said nip whereby said fabric web is shrunk both as it moves through said nip and from said curved path and fabric finishing occurs in said space;

r) plural guide members having a roll-like shape extending across the width of said belts and said guide members adapted to press said belts against each other and substantially across the width of said belts by having one of said guide members in abutment with one of said belts and said guide members being formed to press against the belt that said guide member abuts to maintain said belt in abutment with the other of said belts and said other guide member also being formed to press against the other of said belts to maintain said other belt in abutment with said fabric web and said guide members being disposed in substantially vertical alignment with each other;

s) means for said fabric treating apparatus connected to said plural guide members to cause one of said guide members to press against one of said belts and said means also to cause another of said guide members to press against another of said belts, and t) said belts being constructed of a fully stretchable material throughout.

2. The apparatus for finishing a fabric web of claim 1 wherein shrinkage of the fabric web takes place in the nip, as a result of the belt curvature and in said space between said belts which are made of a fully stretchable material.

3. The apparatus for finishing a fabric web of claim 2 wherein the first pair of rolls are adapted to be driven at a faster speed then the second pair of rolls so that shrinkage in said space is facilitated.

4. The apparatus for finishing a fabric web of claim 3 wherein the fabric shrinkage is caused by nip compaction, belt curvature, and compaction in said space and the cumulative compaction is over 20 per cent.

* * * * *